United States Patent [19]

Potyondy

[11] 4,036,489

[45] July 19, 1977

[54] 360° SWING

[76] Inventor: Istvan Potyondy, 4828 Zuni St., Denver, Colo. 80221

[21] Appl. No.: 653,726

[22] Filed: Jan. 30, 1976

[51] Int. Cl.[2] ..... A63G 1/20; A63G 9/08

[52] U.S. Cl. ..... 272/49; 272/85

[58] Field of Search ..... 272/85, 89, 86, 87, 272/88, 90, 91, 92, 33 R, 49, 24, 109, 110; 297/217, 273

[56] References Cited

U.S. PATENT DOCUMENTS

| | | | |
|---|---|---|---|
| 1,599,014 | 9/1926 | Hunter | 272/49 |
| 1,660,139 | 2/1928 | Shellabarger | 272/49 |
| 2,403,593 | 7/1946 | Franklin | 272/49 X |
| 2,548,375 | 4/1951 | Joncas | 272/85 |

FOREIGN PATENT DOCUMENTS

| | | | |
|---|---|---|---|
| 652,661 | 10/1928 | France | 272/109 |
| 326,634 | 3/1930 | United Kingdom | 272/89 |

*Primary Examiner*—Richard C. Pinkham

*Assistant Examiner*—Arnold W. Kramer

*Attorney, Agent, or Firm*—Marden S. Gordon

[57] ABSTRACT

A swing for use by individuals for exercise or amusement in which theuser can operate the swing independently or in which the user can be assisted by another individual to gain momentum to maneuver the swing through a complete 360° circular arc. The 360° swing is entirely mechanical, requiring no electrical parts, consisting of a series of vertical supports which can either be secured on their bottom ends into the ground or with round plates for support on top of the ground, a top cross bar which is securely affixed to the top of the vertical supports conjoined thereto by means of self aligning block bearings on each end, side arms securely affixed to each end of the cross bar to provide a crank mechanism for assistance in gaining momentum by other individuals, and a seat equipped with safety straps and supported by swinging bars securely attached to said cross bar, with the cross bar and swing mechanism being fully rotatable through a 360° arc.

6 Claims, 4 Drawing Figures

FIG. 2
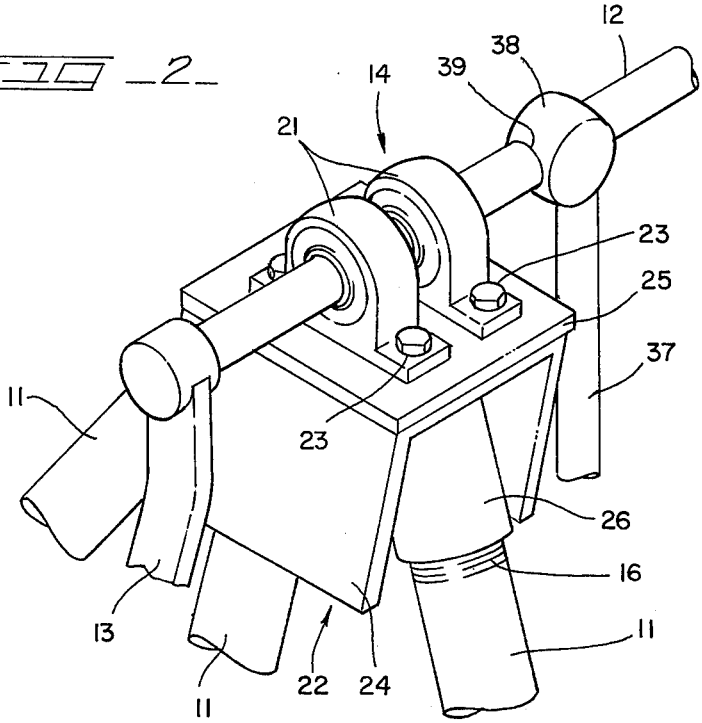
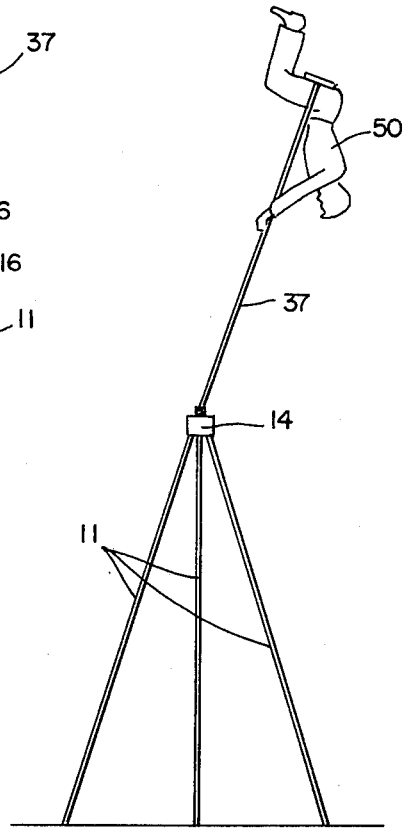
FIG. 3
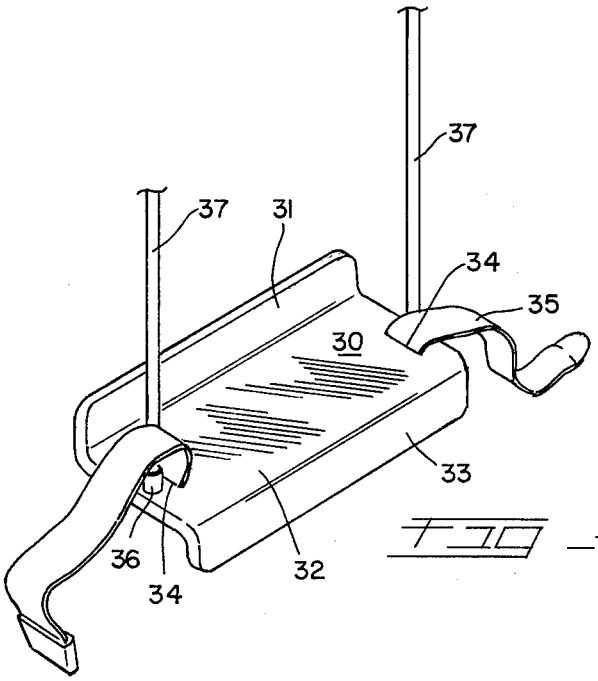
FIG. 4

360° SWING

BACKGROUND OF THE INVENTION

1. Field of the Invention

This invention relates to a swing for exercise or amusement with which the user can swing either in a conventional manner through a smaller arc or through a complete circular arc of 360°.

2. Description of the Prior Art

Swings are described in prior art for amusement or exercise purposes, but none are described wherein a person might rotate through a complete circular arc of 360° by one's own momentum. Likewise, patents are described wherein devices are available for the operator of the swing for assistance in gaining initial momentum. For example, U.S. Pat. No. 294,983 (1884) discloses a swing wherein the operator might provide initial momentum by means of a lever and a cord; U.S. Pat. No. 1,960,671 also discloses an assist device by which the operator of the swing may add momentum to the swing. U.S. Pat. No. 583,876 (1897) describes a swing and churn atachment consisting of a frame properly balanced and mounted with a swing pivoted therein, provided with seats, foot-rests, springs, lever, and cords operating the same, together with a mechanism for operating the churn. U.S. Pat. No. 2,564,547 (1946) describes a power-driven swing which drives a crankshaft associated with the swing so as to apply force to the swing in one direction only. There is, then, an obvious void in the marketplace which can be filled and meet with considerable consumer demand by means of a swing that would enable the operator to be assisted in obtaining initial momentum that would enable the operator of the swing to rotate about a complete 360° circular arc.

SUMMARY OF THE INVENTION

The present invention provides a novel swing for use by individuals for exercise or amusement wherein the operator of the swing can be assisted by other individuals in gaining initial momentum and in which the operator can swing in a circular arc from 0° to 360°.

It is a feature of the present invention to provide a 360° swing.

A further feature of the present invention provides a 360° swing which is easy to use and reliable and safe in operation.

Yet still a further feature of the present invention provides a 360° swing which is of a rugged and durable construction and which, therefore, may be guaranteed by the manufacturer to withstand rough and continual usage Other features of this invention will be apparent during the course of the following description.

BRIEF DESCRIPTION OF THE DRAWINGS

In the accompanying drawings forming a part of this specification, and in which like reference characters are employed to designate like parts throughout the same:

FIG. 2 is a partial perspective view of the top cross bar as supported on one end by means of self aligning block bearings; and FIG. 3 is a side orthographic projection of an operator swinging in the extreme vertical position; and FIG. 4 is a perspective view of the seat provided with a safety strap.

DESCRIPTION OF THE PREFERRED EMBODIMENT

Figure 1:
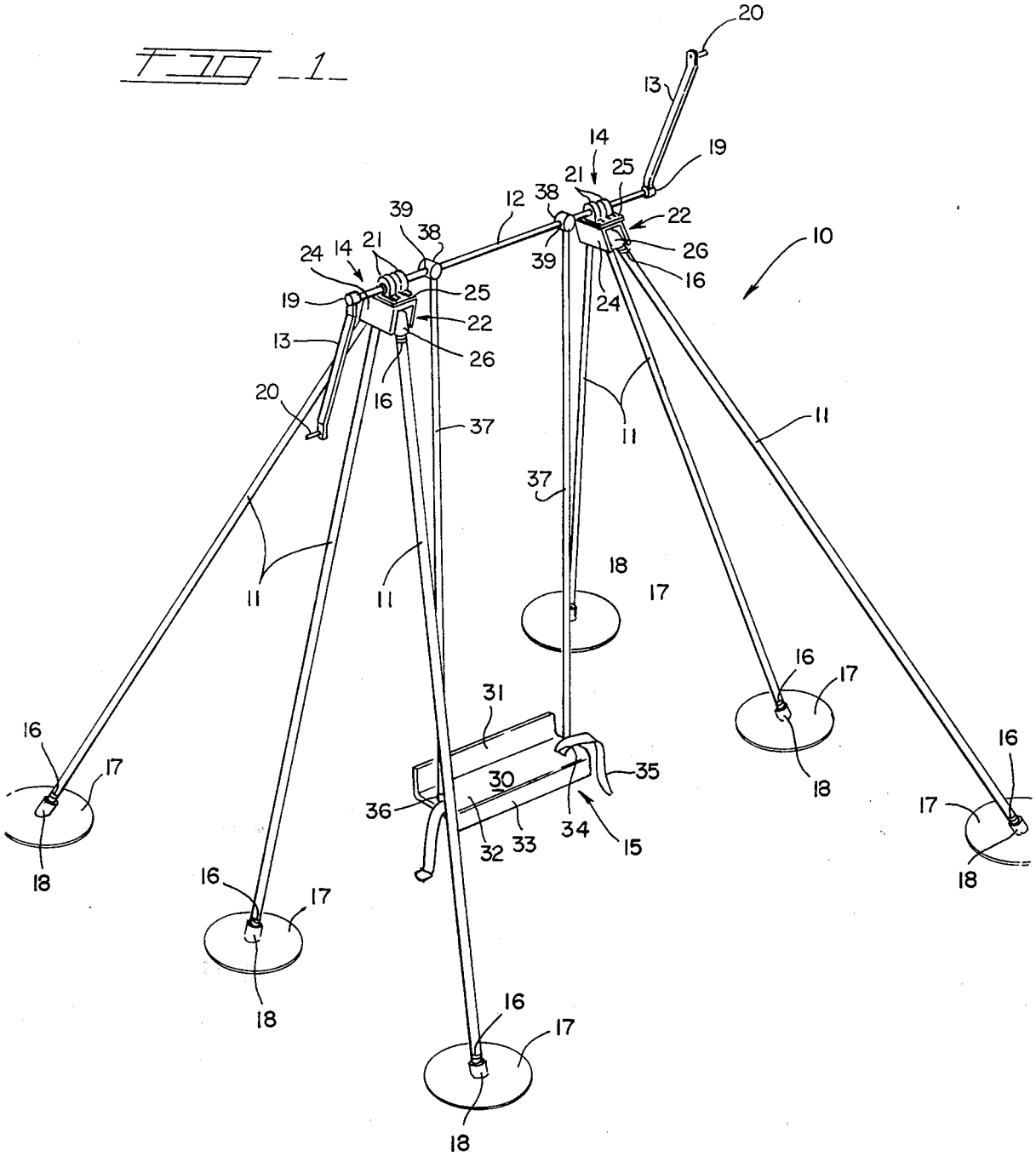
FIG. 1 is a perspective view of the 360° swing with the seat in a rest position and with the swing further supported on the ground by a series of circular plates.

Referring now to the drawings in detail, there is illustrated a preferred form of the 360° swing constructed in accordance with the principles of the present invention and which is designated generally in its entirety by the reference numeral 10 and which is comprised of a series of vertical support bars 11, a top cross bar 12 which is attached on each end to a crank handle 13, two bearing and bracket assemblies 14, a swing seat assembly 15, and associated hardware and interconnecting components as will be later described.

The vertical support bars 11 are constructed of round steel bars with suggested dimensions of approximately $\frac{5}{8}$ inch diameter × approximately 10 feet in length and are provided on each end wth external threads 16 for threadably attaching each opposite end of each vertical support bar 11 to the bearing and bracket assembly 14 on one end and to the bottom support plates 17 on the other end. The bottom support plates 17 are constructed of round durable metal disks or plates and, as shown in FIG. 1, are securely affixed, such as by welding, to a round threaded nipple 18 with the round threaded nipples 18 being angularly disposed to match the vertical angle of the vertical support bars 11 so that the bottom of the support plates 17 rest flat on the ground after assembly. The vertical support bars 11 can either be secured on their bottom ends directly into the ground, such as being reinforced by cement, with or without attachment of the bottom support plates 17 thereto, or, on the other hand, the vertical support bars 11 can be rested on their bottom ends directly onto the ground with the bottom support plates 17 affixed thereto.

The top cross bar 12 is constructed of a round durable bar, such as cold rolled steel, with suggested dimensions of approximately 1 inch in diameter × 38 inches in length. A crank handle 13 is securely affixed to each end of the top cross bar 12, with the crank handle 13 consisting of a rectangular steel bar provided on one end with a conventional union 19 and with a shaft 20 securely affixed, such as by welding, on the opposite end and provided to protrude perpendicularly from the side of the crank handle 13. The two unions 19 are affixed on each end of the top cross bar 12 in any conventional way, such as by welding or threaded attachment, so that each crank handle 13 is positioned on the top cross bar 12 to be diametrically opposed in direction with one crank handle 13 running downwardly from the top cross bar 12 while the other crank handle 13 runs upwardly.

The bearing and bracket assembly 14 is provided one each toward each end of the top cross bar 12 and consists of one or more self aligning block bearings 21 which, as shown in FIGS. 1 and 2, are secured to the bracket 22 by means of the bolts 23. The bracket 22 is constructed of durable material, such as $\frac{1}{4}$ inch steel, and consists of a U-shaped bracket 24 which is securely affixed, such as by welding, to reinforcement plate 25. A series of threaded nipples 26 are securely affixed, such as by welding, to the interior of the U-shaped bracket 24 so as to be angularly disposed for threadable attachment of the respective vertical support bar 11 by means of the external threads 16 provided thereon.

The swing seat assembly 15 consists of a seat 30 which is constructed of durable material, such as metal or high density plastic, which is integrally formed out of a single piece of material to provide a back rest portion 31, which is formed in a vertical upward position with the horizontal rest portion 32 which, in turn, is formed with the front leg support portion 33 being perpendicularly and vertically affixed in a downward position from the front of the horizontal rest 32. The horizontal rest portion 32 is provided with two rectangular slots 34 on each of its ends, as shown in FIGS. 1 and 4, through which the strap or belt 35 is assembled through one of the rectangular slots 34, along the bottom of the horizontal rest portion 32 and up through the opposite rectangular slot 34. Although it is not shown for the purposes of clarity of explanation, the bottom of the seat 30 could be reinforced by means of metal plates or the like. The horizontal rest portion 32 of the seat 30 is further provided on each end with threaded nipples 36 which are securely affixed in any conventional way, such as by welding to a metal seat or by being attached with a nut on the bottom of the seat 30, or the like. Two swing bars 37 are constructed of round durable material, such as steel rod, and are threadably connected on one end to the nipples 36 on the seat 30 and are provided on their opposite ends with the cylindrical support brackets 38 which are securely affixed to the swings bars 37, such as by welding, and are provided with a round through hole 39 for positioning over the top cross bar 12 and securely affixed thereto in a conventional way, such as by welding, set screws, or the like.

In operation, the 360° swing 10 would be provided to the consumer for purposes of compactness in shipping or handling in sections, with the vertical support bars 11, the bottom support plates 17, the bearing and bracket assemblies 14, the seat 30, and the top cross bar 12, the swing bars 37, and the crank handles 13 being unassembled. To set the swing up, the vertical support bars 11 would be threadably attached to the threaded nipples 26 of the bearing and bracket assembly 14 on one end and to the bottom support plates 17 on the other end, the top cross bar 12 and the crank handles 13 and including the swing bars 17 with the seat 30 would be assembled to the bearing and bracket assembly 14 and attached to the reinforced plate 25 and the U-shaped bracket 24 by means of the bolts 23. The 360° swing 10 would then set upright to rest either on the ground or to be affixed within the ground with cement reinforcement. The user of the swing would then sit on the seat 30, fasten himself onto the seat 30 by means of the belt 35 in a conventional way and grasp the swing bars 37, each hand. in eachhand. One or two other people can assist the operator to gain momentum by tying ropes around the shafts 20 on the crank handles 13 and each person alternately pulling on the ropes to rotate the crank handles 13 to provide rotation of the top cross bar 12 jointly with the swing bars 37. Alternatively, the operator can gather momentum in a conventional way, and, in either case, can swing in a conventional swinging arc or, as shown in FIG. 3, the operator can swing in a complete arc of 360° as shown by the reference numeral 50.

There is thus provided a novel 360° swing which meets all of its stated objectives and enables the operator thereof to swing in any arc from 0° to 360° by manual efforts alone and without the aid of a power-driven mechanism.

It is to be understood that the form of this invention as shown and described is to be taken as a preferred example thereof, and that this invention is not to be limited to the exact arrangement of parts described in the description or illustrated in the drawings as changes thereto in the details thereof pertaining to size, shape and arrangement of parts thereof are envisioned within the scope of the invention without departing from the novel concepts of the invention.

Having thus described the invention, what is claimed is:

1. A 360° swing for the exercise and amusement of users thereof wherein the user can swing through any circular arc from 0° to 360°, the device comprising, in combination:

a series of round vertical support bars provided with external threads on each end thereof for threadably attaching or detaching the support bars to an overhead bracket on one end and to a metal support plate on the bottom end;

a round top cross bar to which is rigidly affixed two swing bars axially spaced along the length of the top cross bar and with a crank handle being rigidly affixed to each end of the top cross bar;

two bearing and bracket assemblies for supporting said top cross bar consisting of one or more self aligning block bearings per assembly, a reinforcement plate, and a U-shaped bracket to the underside of which is rigidly affixed a series of threaded nipples which are angularly displaced for threadable attachment to the vertical support bars;

a swing seat assembly including a rigid seat with a back rest, a seat rest, and a leg support section thereof and with the seat portion being provided with two rectangular slots on each end thereof for securement of a safety strap thereto, and with the seat portion further being provided with means, such as nipples, on each end for secure attachment of the seat to the swing bars; and two swing bars rigidly attached on their top ends to the top cross bar to provide swinging of the seat assembly concurrent with rotation of the top bar.

2. A 360° swing as described in claim 1 wherein the bottom support plates consist of a round steel disk with a threaded nipple securely attached on one side thereto, such as by welding, and being angularly displaced for threadable attachment to the vertical support bars so that the bottom support plates rest flat on the ground.

3. A 360° swing as set forth in claim 1 wherein said two crank handles are securely affixed to each end of the top cross bar and are provided with a protruding shaft to which ropes can be tied so that individuals, other than the operator of the swing, might thereby assist the operator of the swing in gaining initial momentum.

4. A 360° swing as set forth in claim 1 wherein the vertical support bars, the top cross bar and bearing assemblies, the swing seat assembly, and the bottom support plates can be threadably attached and detached for compactness in the handling and transportation of the 360° swing.

5. A 360° swing as set forth in claim 1 wherein the operator of the 360° swing may swing in conventional manner or may swing through a complete circular arc of 360° by means of the operator's own effort and without any power-driven assists thereto.

6. A 360° swing for the exercise and amusement of users thereof wherein the user can swing through any circular arc from 0° to 360°, the device comprising, in combination:

a pair of ground engaging upstanding support means;

a bearing and bracket assembly mounted at the top of each support means;

a top cross bar of a length greater than the distance between said bearing and bracket assemblies, supported thereby for rotation about its horizontal axis;

a crank handle rigidly affixed to each end of the top cross bar;

two spaced swing bars rigidly attached at their top ends to the top cross bar; and a passenger supporting assembly rigidly attached to the bottom ends of said swing bars, with safety means associated with said passenger supporting assembly to prevent the passenger becoming detached therefrom in any position of said passenger supporting assembly, whereby the passenger together with the swing bars and passenger supporting assembly can swing through any circular arc from 0° to 360° by effort of the passenger, aided, as desired, by other individuals manually actuating the crank handles.

* * * * *